US009439836B1

(12) United States Patent
Thomas

(10) Patent No.: US 9,439,836 B1
(45) Date of Patent: Sep. 13, 2016

(54) STIMULATING PACIFIER

(71) Applicant: Monica H. Thomas, Gainesville, FL (US)

(72) Inventor: Monica H. Thomas, Gainesville, FL (US)

( * ) Notice: Subject to any disclaimer, the term of this patent is extended or adjusted under 35 U.S.C. 154(b) by 20 days.

(21) Appl. No.: 14/525,730

(22) Filed: Oct. 28, 2014

Related U.S. Application Data

(60) Provisional application No. 61/896,314, filed on Oct. 28, 2013.

(51) Int. Cl.
*A61J 17/00* (2006.01)

(52) U.S. Cl.
CPC ..... *A61J 17/00* (2013.01); *A61J 2017/002* (2013.01); *A61J 2017/005* (2013.01)

(58) Field of Classification Search
CPC .... A61J 17/001; A61J 17/002; A61J 17/003; A61J 17/005; A61J 17/006; A61J 17/007; A61J 17/008
See application file for complete search history.

(56) References Cited

U.S. PATENT DOCUMENTS

| | | | | |
|---|---|---|---|---|
| 2,889,829 | A * | 6/1959 | Tannenbaum | A61J 17/00 215/11.1 |
| 3,186,411 | A | 6/1965 | Skidmore | |
| 4,192,307 | A | 3/1980 | Baer | |
| 4,688,571 | A | 8/1987 | Tesler | |
| 5,007,924 | A * | 4/1991 | Jekel | 606/234 |
| 5,300,024 | A * | 4/1994 | Yang | 604/73 |
| 5,662,685 | A * | 9/1997 | Uhler | 606/234 |
| 5,700,279 | A | 12/1997 | Blando | |
| 6,068,649 | A * | 5/2000 | Chamberlain | 606/234 |
| D443,932 | S | 6/2001 | Wickerman | |
| 6,482,225 | B1 | 11/2002 | Bingham et al. | |
| D472,973 | S | 4/2003 | Bliss et al. | |
| D477,411 | S | 7/2003 | Kroepel | |
| 8,945,182 | B2 * | 2/2015 | Oates, II | A61J 7/0053 604/77 |
| 2006/0058845 | A1 * | 3/2006 | Fuisz et al. | 606/234 |
| 2007/0265661 | A1 * | 11/2007 | Coleman | 606/234 |
| 2012/0252924 | A1 | 10/2012 | Mahoney | |
| 2013/0085475 | A1 | 4/2013 | McNac, III et al. | |

FOREIGN PATENT DOCUMENTS

| | | | |
|---|---|---|---|
| EP | 0185614 | A1 | 6/1986 |

* cited by examiner

*Primary Examiner* — Diane Yabut

(74) *Attorney, Agent, or Firm* — Robert C. Montgomery; Montgomery Patent and Design, LP.

(57) ABSTRACT

A stimulating pacifier device includes a base, a nipple extending from the base, and a sound generator disposed in the base and configured to transmit sound. The device further includes at least one of a liquid fragrance permeable nipple or a flavored fluid dispenser.

18 Claims, 6 Drawing Sheets

STIMULATING PACIFIER

RELATED APPLICATIONS

The present invention is a continuation-in-part of, was first described in, and claims the benefit of U.S. Provisional Application No. 61/896,314, filed Oct. 28, 2013, the entire disclosures of which are incorporated herein by reference.

FIELD OF THE INVENTION

The present invention relates generally to pacifiers and, more particularly, to a pacifier having the ability to glow in the dark, emit sound, dispense flavors, and/or release fragrance in order to provide a more stimulating experience.

BACKGROUND OF THE INVENTION

While caring for a young baby can be one of the most rewarding duties a person may bear, it is often one of the most traumatizing. This is due to the fact that people know so very little about babies due to the amount of time they are exposed to them. Every action, or lack of action, is questioned as to whether or not it is the correct thing for the infant to be doing at that stage of development.

One (1) developmental stage that often causes much duress for infants and toddlers is that of teething. Most teething apparatuses include a simple pacifier having a nipple portion. These work well to assist a toddler with the pain and discomfort of the growing teeth but more can be done.

Infants and toddlers are easily entertained and yearn for stimulation. Providing extra stimulation serves as a distraction for a teething infant or toddler.

Accordingly, there exists a need for a means by which children who are in the teething stage can be provided comfort as well as be distracted through stimulation and entertainment.

SUMMARY OF THE INVENTION

The inventor has recognized the aforementioned inherent problems and lack in the art and observed that there is a need for means for stimulating and/or entertaining an infant with a pacifier. The development of the present invention, which will be described in greater detail herein, substantially departs from conventional solutions to fulfill this need.

In one (1) embodiment, the disclosed stimulating pacifier device includes a base, a nipple extending from the base, and a sound generator disposed in the base and configured to transmit sound.

In another embodiment, the disclosed stimulating pacifier device includes a cylindrical base, a nipple including a proximal end connected to the base and a distal end extending from the base, a sound generating circuit board housed within the base, a battery disposed within the base and in electrical communication with the sound generating circuit, a speaker disposed on an outer surface of the base and in electrical communication with the sound generating circuit board, and an actuator button disposed on the outer surface of the base and in electrical communication between the sound generating circuit board and the battery. Actuation of the actuator button energizes the sound generating circuit board and transmits a sound from the speaker.

Furthermore, the described features and advantages of the disclosure may be combined in various manners and embodiments as one skilled in the relevant art will recognize. The disclosure can be practiced without one (1) or more of the features and advantages described in a particular embodiment.

Further advantages of the present disclosure will become apparent from a consideration of the drawings and ensuing description.

BRIEF DESCRIPTION OF THE DRAWINGS

The advantages and features of the present disclosure will become better understood with reference to the following more detailed description and claims taken in conjunction with the accompanying drawings, in which like elements are identified with like symbols, and in which:

Figure 1:
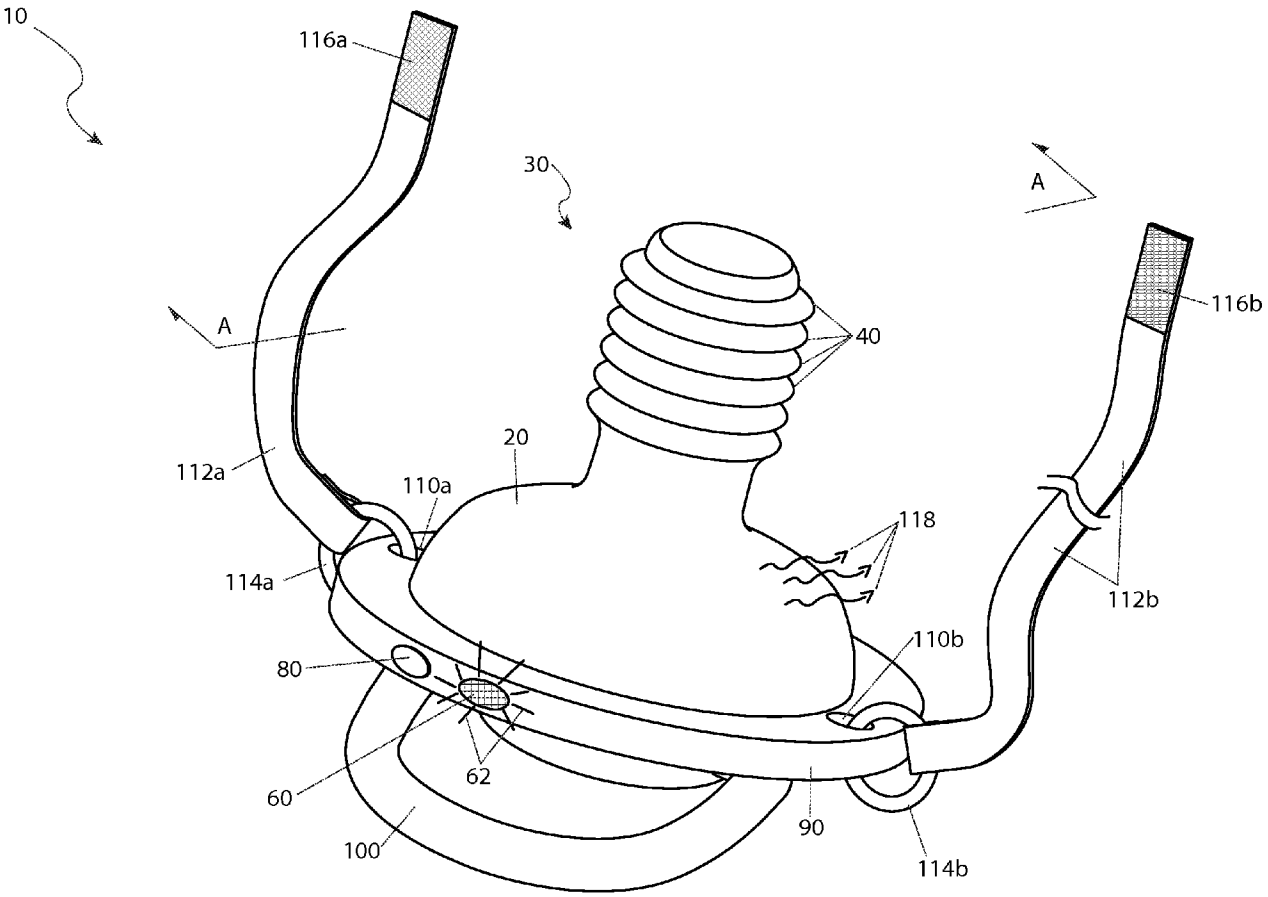
FIG. 1 is a perspective front view of a stimulating pacifier, in accordance with one embodiment of the present invention.

| DESCRIPTIVE KEY | |
|---|---|
| 10 | stimulating pacifier device |
| 20 | oral fixation member |
| 30 | nipple |
| 40 | ribbed surface |
| 60 | speaker |
| 62 | sound |
| 70 | sound generator circuit board |
| 80 | actuator button |
| 90 | base |
| 100 | handle |
| 105 | handle socket |
| 110a | first lanyard aperture |
| 110b | second lanyard aperture |
| 112a | first lanyard |
| 112b | second lanyard |
| 114a | first ring |
| 114b | second ring |
| 116a | first strap fastener |
| 116b | second strap fastener |
| 118 | liquid fragrance |
| 120 | battery |
| 122 | wiring |
| 200 | stimulating pacifier device |
| 220 | oral fixation member |
| 225 | base |
| 230 | nipple |
| 260 | reservoir |
| 265 | pump |
| 270 | cap |
| 271 | flavor fluid |
| 272 | outlet conduit |
| 273 | orifice |
| 274 | inlet conduit |
| 275 | cap aperture |
| 276 | reservoir conduit |

DETAILED DESCRIPTION OF THE PREFERRED EMBODIMENT

In accordance with the invention, the best mode is presented in terms of a one or more of the disclosed embodiments, herein depicted within FIGS. 1 through 6. However, the disclosure is not limited to a single described embodiment and a person skilled in the art will appreciate that many other embodiments are possible without deviating from the basic concept of the disclosure and that any such work around will also fall under its scope.

Further, those skilled in the art will recognize that other styles and configurations can be incorporated into the teachings of the present disclosure, and that the example configurations shown and described herein are for the purpose of clarity and disclosure and not by way of limitation.

As used herein, the singular terms "a", "an", and "the" do not denote a limitation of quantity, but rather denote the presence of at least one (1), as well as a plurality of, the referenced items, unless the context clearly indicates otherwise.

As used herein, the terms "first", "second", "third", etc. are used as labels to describe various elements, features, and/or components, and are not intended to impose ordinal, positional, or hierarchical requirements on the referenced items, unless other indicated. For example, such terms may be used to distinguish one (1) element from another element.

As used herein, relative terms such as "front", "rear", "left", "right", "top", "bottom", "below", "above", "upper", "lower", "horizontal", or "vertical" are used to describe a relationship of one (1) element, feature and/or region to another element, feature and/or region as illustrated in the figures.

Referring generally to FIGS. 1-6, disclosing example embodiments of the disclosed a stimulating pacifier device (herein referred to as the "device") 10 and 200, where like reference numerals represent similar or like parts. In one (1) example embodiment, the device 10 initiates the broadcasting of stimulating sounds 62 to provide a more stimulating experience for an infant while using the device 10. In another example embodiment, the device 200 dispenses flavored fluid 271 into the infant's mouth to provide additional enjoyment. The device 10, 200 is envisioned to be introduced having various attractive appearances, colors, and patterns based upon a user's preferences.

Figure 2:
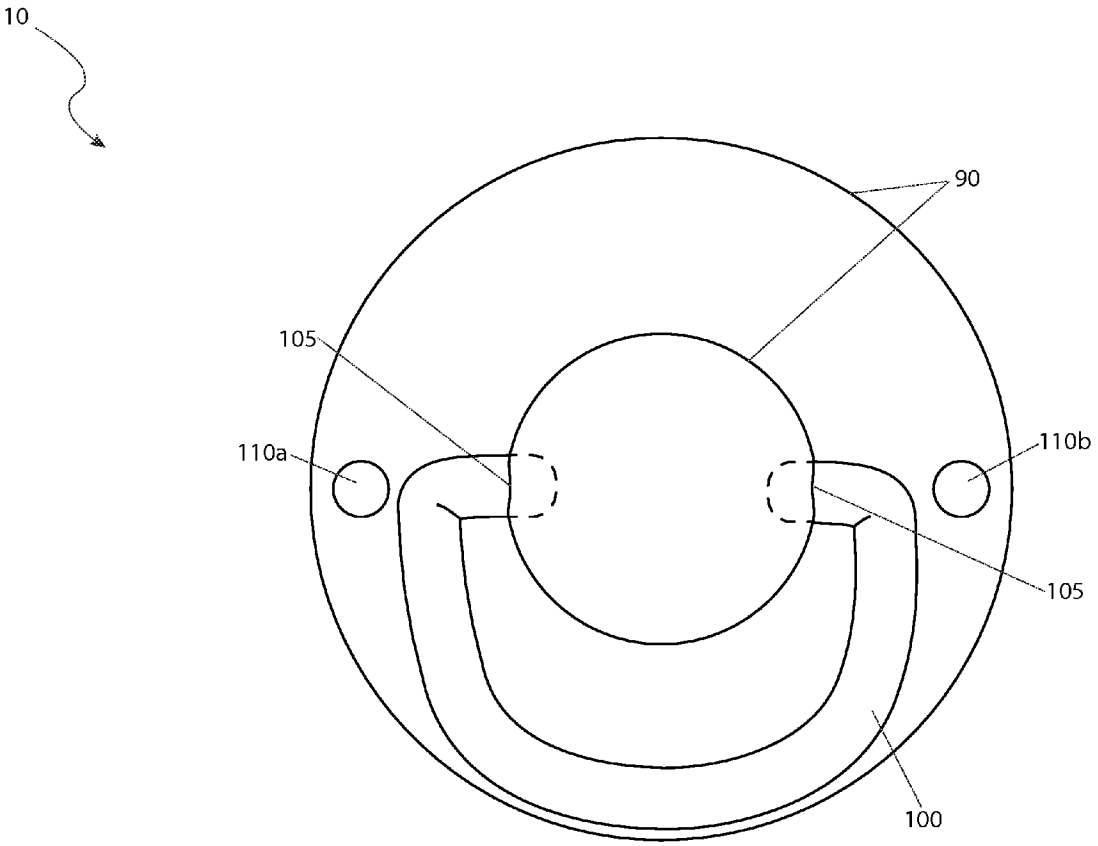
FIG. 2 is a bottom plan view of the stimulating pacifier of FIG. 1.
Figure 3:
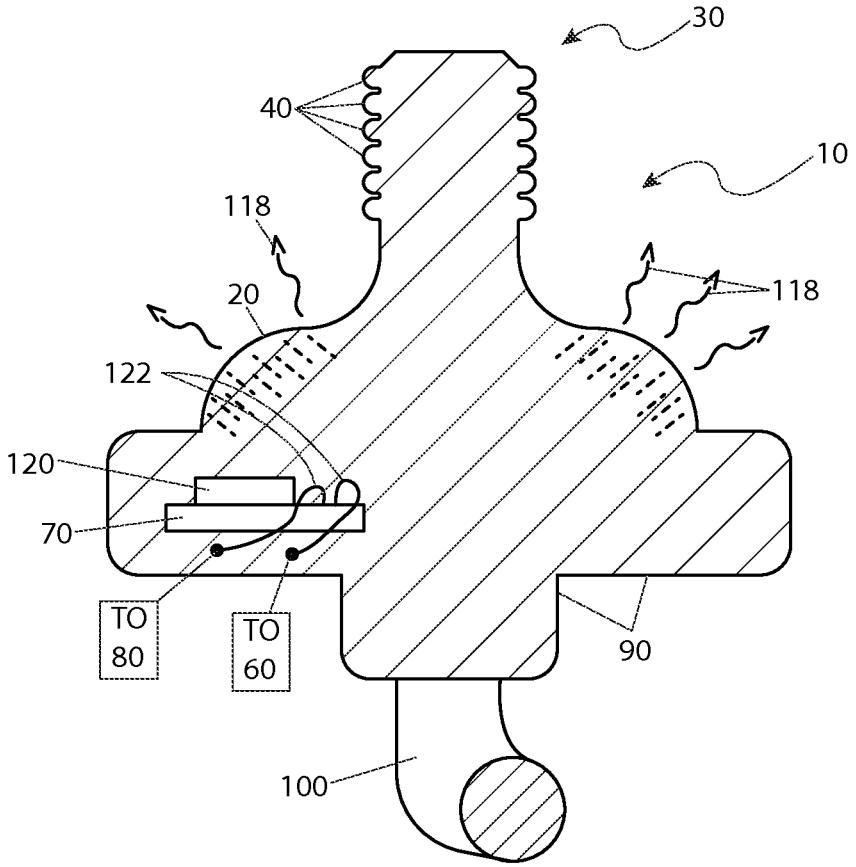
FIG. 3 is a sectional view of the stimulating pacifier taken along section line A-A of FIG. 1.

Referring to FIGS. 1, 2, and 3, one example embodiment of the device 10 includes an oral fixation member 20, a base 90, a handle 100, and a nipple 30. The base 90 and the nipple 30 are connected or integral to one (1) another to form the oral fixation member 20. As one (1) example, the base 90 includes a cylindrical-shape defining an intermediate region (e.g., middle) of the oral fixation member 20. The nipple 30 protrudes upwardly (e.g., perpendicularly upward) from the base 90. The base 90 extends annularly beyond a periphery of the nipple 30.

The base 90 includes a means to produce and broadcast various pre-installed sounds 62 and/or music. As one (1) example, the base 90 includes internal electrical components including a sound generating circuit board 70 and a battery 120 (FIG. 3). The base 90 also includes at least one (1) external speaker 60 (FIG. 1) located along an outer edge. An actuator button 80 (FIG. 1) is located along the outer edge of the base 90, which when pressed, initiates the sounds 62 from the speaker 60.

The nipple 30 includes a first (e.g., proximal) end connected or integral to the base 90. The nipple 30 includes a second (e.g., distal) end opposite the first end. The nipple 30 has an elongated, generally cylindrical or bulbous shape extending from the first end to the second end. The second end of the nipple 30 includes a cross-sectional dimension (e.g., diameter) less than a cross-sectional dimension (e.g., diameter) of the first end. For example, the first end of the nipple 30 extends laterally outward toward a periphery of the base 90. In one (1) example construction, the nipple 30 is made of a soft resilient polymer material. In one (1) example embodiment, at least a portion of an outer surface of the nipple 30 (e.g., at the second end) includes a plurality of parallel annular ribs 40 formed into side surfaces to ease discomfort during teething of the infant.

The oral fixation member 20 includes a "U"-shaped handle 100 rotatably connected to a bottom surface of the base 90 for grasping and/or holding the device 10. End portions of the handle 100 are inserted into diametrically opposing handle socket 105 (FIG. 2) formed into the bottom portion base 90.

As one (1) example construction, the handle 100 is made using a rigid photoluminescent plastic material to enable easy location of the device 10 in low light situations. For example, the handle 100 can be impregnated with photoluminescence materials that exhibit photo-excitation when exposed to light within the range of the visible spectrum. The molecular characteristics of the photoluminescence material demonstrate absorption to emission ranges between several minutes to several hours, depending upon the length of photo-excitation activity the device is exposed to. The photo-excitation provides a user with a handle 100 that emits light for several minutes or hours after being exposed to periods of light within the visible spectrum. Thus, if the device 10 is utilized in low light situations after being exposed to visible light, it will appear to glow in the dark.

In one (1) example embodiment, the oral fixation member 20 includes two (2) lanyard apertures 110*a*, 110*b* (FIGS. 1 and 2) formed through opposing edge portions of the base 90. Each lanyard aperture 110*a*, 110*b* being configured to receive a respective ring 114*a*, 114*b* (FIG. 1), which is in turn connected to a respective fabric strap-type lanyard 112*a*, 112*b* (referred collectively herein as lanyard 112) (FIG. 1). Each lanyard 112*a*, 112*b* (referred to herein as a first lanyard 112*a* and second lanyard 112*b*) includes a strap fastener 116*a*, 116*b* (referred to herein as a first strap fastener 116*a* and second strap fastener 116*b*) (e.g., either a hook piece or a loop piece of a hook-and-loop fastener) at distal ends thereof, which allows for the two (2) lanyards 112 to be wrapped around and secured to a handbag, an infant bib, or the like.

In another example embodiment, the oral fixation member 20 may be made of a semi-permeable material to facilitate transmission and expulsion of a liquid fragrance 118 (FIGS. 1 and 3). Once exposed to the liquid fragrance 118, molecules of the liquid fragrance 118 would enter the interstitial molecular sites of the oral fixation member 20 and be retained therein. Once entrained in the interstitial sites, molecules of the liquid fragrance 118 would slowly emit from the oral fixation member 20 and create an aromatic odor for the infant using the device 10 or those who are in close proximity with the device 10. As one (1) example, the nipple 30 can be either pre-impregnated or submerged in the liquid fragrance 118, whereupon molecules of the liquid fragrance 118 are imparted upon the surface of the nipple 30 via adsorption. It is envisioned that various liquid fragrances 118 may be used without limitation.

Figure 4:
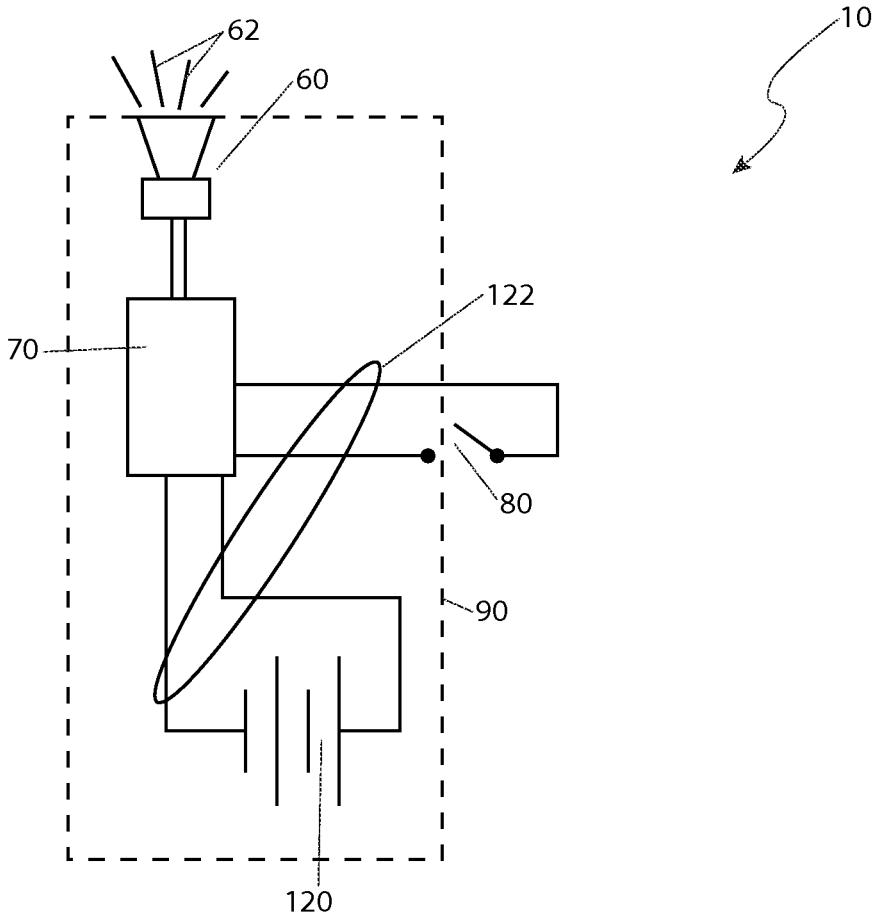
FIG. 4 is an electrical block diagram of the stimulating pacifier, in accordance with one (1) embodiment of the present invention.

Referring now to FIG. 4, the base 90 includes the least one (1) speaker 60 in electrical communication (e.g., via wiring 122) with the sound generating circuit board 70 powered by an on-board battery 120. The sound generating circuit board 70 is in electrical communication (e.g., via wiring 122) with the actuator button 80 disposed on an outer surface of the base 90. When an electrical circuit is closed, electrical power is supplied to the sound generating circuit board 70, which in turn transmits a sound signal to the speaker 60 to emanate various sounds 62, such as musical melodies or other sounds 62 intended to stimulate the infant.

Figure 5:
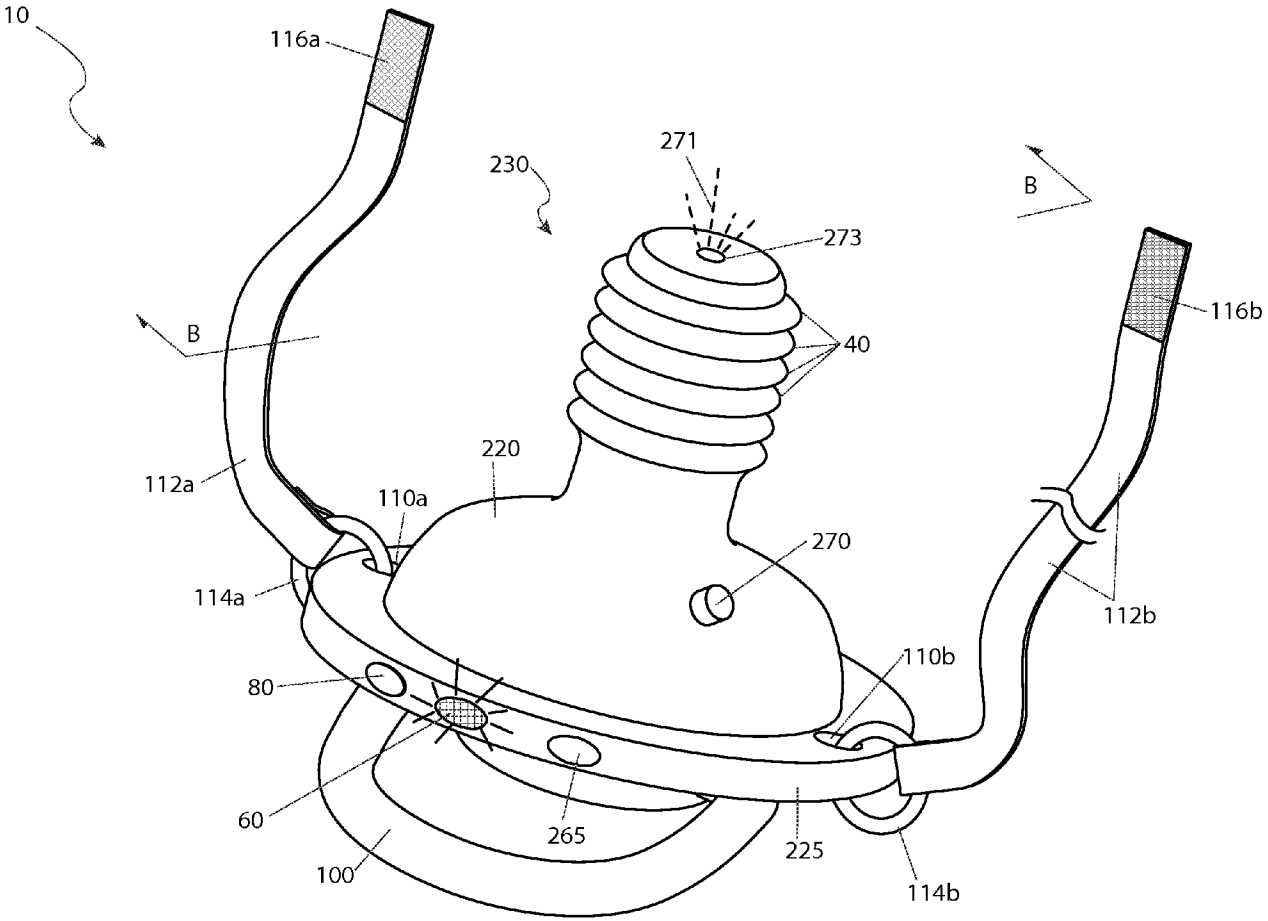
FIG. 5 is a perspective view of the stimulating pacifier, in accordance with another embodiment of the present invention; and, FIG. 6 is a sectional view of the stimulating pacifier taken along section line B-B of FIG. 5.
Figure 6:
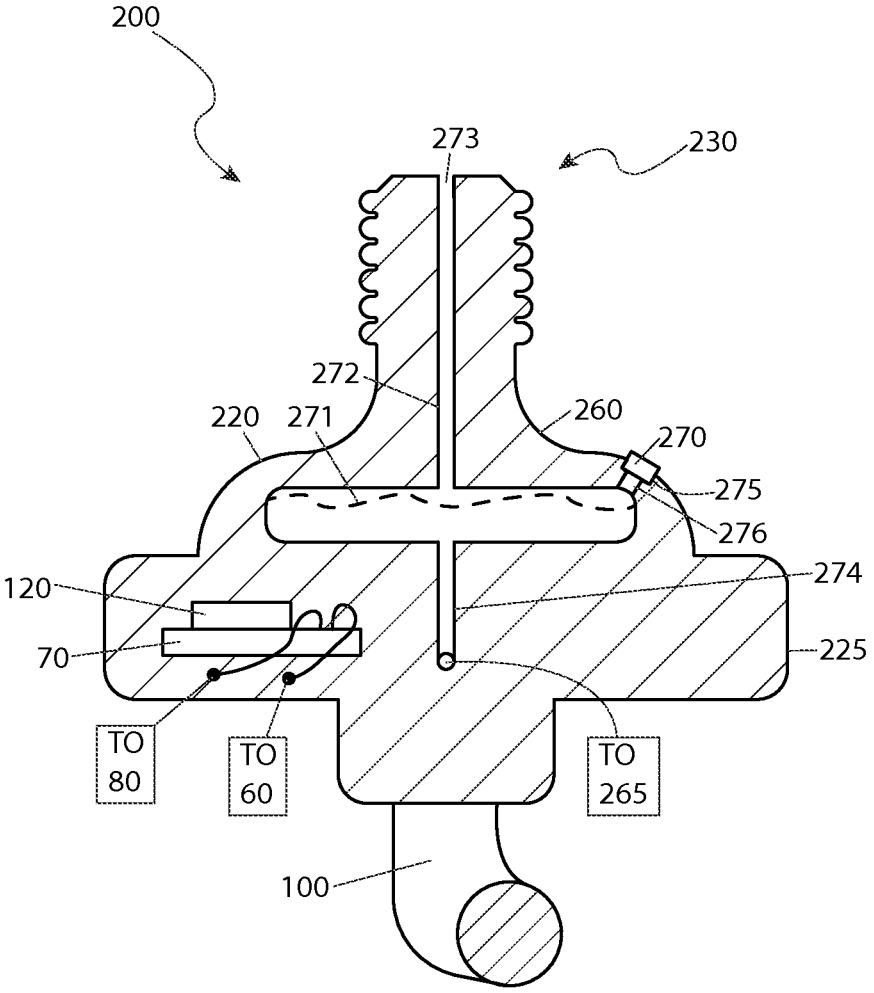

Referring to FIGS. 5 and 6, another example embodiment of the disclosed device 200 dispenses flavored fluid 271 through a nipple 230, being inserted into the infant's mouth. The device 200 includes oral fixation member 220 and base 225, which facilitate containment of a flavored fluid 271. The oral fixation member 220 includes a bulb-type pump 265 incorporated within a side surface of the base 225 and adjacent to the speaker 60 and actuator button 80.

The pump 265 includes a protruding (e.g., dome-shaped) surface portion, which when pressed upon, conducts a pressure through an inlet conduit 274 (FIG. 6) to a fluid reservoir 260 located within the oral fixation member 220. The pressure upon the reservoir 260 causes a flavored fluid 271 contained therein to travel through an integral tubular outlet conduit 272 extending centrally through the nipple 230 and exit through an orifice 273 centered upon the second end of the nipple 230.

The reservoir 260 is provided with a means to replenish or replace the flavored fluid 271, as desired, via an access cap 270. The cap 270 is located along a side surface of the oral fixation member 220. The cap 270 is inserted into a cap aperture 275 of the oral fixation member 220, which leads to a reservoir conduit 276 (FIG. 6) in fluid communication with the reservoir 260, and retained therein preferably via a friction fit.

As a caregiver presses upon the pump 265, a quantity of flavored fluid 271 is transferred from the nipple 30 into the infant's mouth, which creates a pleasing taste for the infant. It is envisioned that flavored fluids 271 may be introduced having various flavors without limitation.

Those skilled in the art will recognize that other styles and configurations of the disclosed device 10 can be easily incorporated into the teachings of the present disclosure, and only particular example embodiments and configurations have been shown and described for purposes of clarity and disclosure and not by way of limitation of scope.

One embodiment of the disclosed method utilizing the device 10 may be achieved by performing the following steps: 1). acquiring a model of the device 10 having a desired external appearance; 2). submerging the nipple 30 in a liquid fragrance 118, if not previously impregnated; 3). allowing a period of time for the oral fixation member 20 and nipple 30 portions to absorb the liquid fragrance 118; 4). inserting the nipple 30 of the device 10 into an infant's mouth in a normal manner; 5). allowing the infant to enjoy the aromatic effect of the liquid fragrance 118; 6). pressing upon the actuator button 80 to initiate various sounds 62 and music to then be emitted from the speaker 60; 7). exploiting the ribbed surface 40 of the nipple 30 to sooth the effects of teething; 8). utilizing the glowing of the handle 100 to enable easy location of the device 10 in low light situations; and 9). utilizing the tethering feature of the device 10 by wrapping the lanyards 112*a*, 112*b* around an ancillary object and attaching the strap fasteners 116*a*, 116*b* of the lanyards 112*a*, 112*b* together. Accordingly, users of the disclosed device 10 benefit from the enhanced stimulating effects being appreciated by an infant while utilizing the device 10.

Another embodiment of the disclosed method for utilizing the device 200 may be achieved by performing the following steps: 1). procuring the device 200; 2). adding a volume of a desired flavored fluid 271 into the reservoir 260, if not previously filled, by pulling out the cap 270; 3). adding the volume of flavored fluid 271 into the reservoir 260; 4). replacing the cap 270; 5). inserting the nipple 230 of the device 200 into the infant's mouth in a normal manner; 6). pressing upon the pump 265 to dispense a quantity of flavored fluid 271 from the orifice 273 and into the infant's mouth when desired; and 7). allowing the infant to appreciate and be stimulated by the enjoyable taste of the flavored fluid 271.

The foregoing descriptions of example embodiments have been presented for purposes of illustration and description. They are not intended to be exhaustive or to limit to the precise forms disclosed and many modifications and variations are possible in light of the above teachings. The embodiments were chosen and described in order to best explain principles and practical application to enable others skilled in the art to best utilize the various embodiments with various modifications as are suited to the particular use contemplated.

What is claimed is:

1. A stimulating pacifier device comprising:

a base;

a fluid reservoir integrally disposed within said base, wherein said fluid reservoir is configured to hold a volume of flavored liquid;

a nipple extending from said base, said nipple comprising an orifice disposed opposite said base;

an outlet conduit integrally formed within said base and that extends from said fluid reservoir through said nipple and terminates at said orifice to fluidly couple said fluid reservoir and said orifice;

a reciprocating diaphragm pump disposed within said base and operably connected to and in fluid communication with said fluid reservoir;

an inlet conduit integrally formed within said base and that extends from said pump to said fluid reservoir to fluidly couple said pump and said fluid reservoir; and, a sound generator disposed in said base and configured to transmit sound;

wherein actuation of said pump increases an internal pressure of said fluid reservoir to dispense a fractional amount of said flavored liquid through said orifice.

2. The device of claim 1, wherein said sound generator comprises:

a sound generating circuit board housed within said base;

a battery disposed within said base and in electrical communication with said sound generating circuit; and, a speaker disposed on an outer surface of said base and in electrical communication with said sound generating circuit board.

3. The device of claim 2, wherein said sound generator further comprises an actuator button disposed on said outer surface of said base and in electrical communication between said sound generating circuit board and said battery.

4. The device of claim 1, wherein said nipple comprises a plurality of annular ribs extending from an outer surface.

5. The device of claim 4, wherein said plurality of annular ribs are parallel to one another.

6. The device of claim 4, wherein said plurality of annular ribs are disposed at a distal end of said nipple.

7. The device of claim 1, wherein said nipple comprises a semi-permeable material capable of absorbing a liquid fragrance.

8. The device of claim 1, wherein said nipple is pre-impregnated with a liquid fragrance.

9. The device of claim 1, further comprising a handle connected to said base opposite said nipple.

10. The device of claim 9, wherein said handle comprises a glow-in-the-dark material.

11. The device of claim 1, further comprising a pair of lanyards connected to said base, wherein each lanyard comprises a fastener for connecting said pair of lanyards together.

12. The device of claim 1, further comprising a reservoir conduit integrally formed within said base and that extends from a fill aperture formed in said base to said fluid reservoir to fluidly couple said fluid reservoir and said fill aperture;

wherein said fluid reservoir is filled with said flavored liquid through said reservoir conduit.

13. The device of claim 12, further comprising a cap removably connected to said base for covering said fill aperture and closing said reservoir conduit.

14. A stimulating pacifier device comprising:

a cylindrical base;

a fluid reservoir integrally disposed within said base, wherein said fluid reservoir is configured to hold a volume of flavored liquid;

a nipple extending from said base, said nipple comprising a proximal end connected to said base, a distal end opposite said base, and an orifice disposed through said distal end;

an outlet conduit integrally formed within said base and that extends from said fluid reservoir through said nipple and terminates at said orifice to fluidly couple said fluid reservoir and said orifice;

a reciprocating diaphragm pump disposed within said base and operably connected to and in fluid communication with said fluid reservoir;

an inlet conduit integrally formed within said base and that extends from said pump to said fluid reservoir to fluidly couple said pump and said fluid reservoir;

a sound generating circuit board housed within said base;

a battery disposed within said base and in electrical communication with said sound generating circuit;

a speaker disposed on an outer surface of said base and in electrical communication with said sound generating circuit board; and, an actuator button disposed on said outer surface of said base and in electrical communication between said sound generating circuit board and said battery;

wherein actuation of said pump increases an internal pressure of said fluid reservoir to dispense a fractional amount of said flavored liquid through said orifice; and wherein actuation of said actuator button energizes said sound generating circuit board and transmits a sound from said speaker.

15. The device of claim 14, wherein said nipple comprises a plurality of parallel annular ribs extending from an outer surface.

16. The device of claim 14, wherein said nipple comprises a semi-permeable material comprising a plurality of interstitial molecular sites capable of absorbing liquid fragrance.

17. The device of claim 14, further comprising a handle connected to said base opposite said nipple, said handle comprising a photoluminescence material.

18. The device of claim 14, further comprising:

a reservoir conduit integrally formed within said base and that extends from a fill aperture formed in said base to said fluid reservoir to fluidly couple said fluid reservoir and said fill aperture; and, a cap removably connected to said base for covering said fill aperture and closing said reservoir conduit;

wherein said fluid reservoir is filled with said flavored liquid through said reservoir conduit.

* * * * *